US007662044B2

(12) United States Patent
Corne et al.

(10) Patent No.: US 7,662,044 B2
(45) Date of Patent: Feb. 16, 2010

(54) DUAL-FUNCTION SKATE RAIL

(76) Inventors: Joseph E. Corne, 27095 Via Callado, Mission Viejo, CA (US) 92691; Kevin E. Wright, P.O. Box 632, Bailey, CO (US) 80421

( * ) Notice: Subject to any disclaimer, the term of this patent is extended or adjusted under 35 U.S.C. 154(b) by 357 days.

(21) Appl. No.: 11/796,847

(22) Filed: Apr. 30, 2007

(65) Prior Publication Data

US 2008/0268969 A1 Oct. 30, 2008

(51) Int. Cl.
*A63C 19/10* (2006.01)
*A63G 21/00* (2006.01)

(52) U.S. Cl. ..... 472/88; 472/91; 256/65.02

(58) Field of Classification Search ..... 472/88–91; 256/1, 67, 65.02; 482/15–17
See application file for complete search history.

(56) References Cited

U.S. PATENT DOCUMENTS

| | | | | |
|---|---|---|---|---|
| 5,718,412 | A * | 2/1998 | Levanas | 256/1 |
| 6,305,670 | B1 * | 10/2001 | Ward et al. | 256/59 |
| 6,547,221 | B1 * | 4/2003 | Bork et al. | 256/65.01 |
| 6,551,192 | B1 * | 4/2003 | Rieber et al. | 472/88 |
| 2002/0050589 | A1 * | 5/2002 | Nestel | 256/67 |
| 2003/0035686 | A1 * | 2/2003 | Lee | 403/379.5 |

* cited by examiner

*Primary Examiner*—Kien T Nguyen
(74) *Attorney, Agent, or Firm*—QuickPatents, Inc.; Kevin Prince

(57) ABSTRACT

An improved skate rail having the dual-function of a flat surface and a round surface in one device. The skate rail allows the skateboard rider to easily choose either the flat surface or the round surface. A locking mechanism holds the skate rail securely in either position.

5 Claims, 5 Drawing Sheets

DUAL-FUNCTION SKATE RAIL

FIELD OF THE INVENTION

This invention relates to skateboard products.

BACKGROUND OF INVENTION

The skateboard is typically an oblong-shaped piece of plywood with four roller-skate type wheels attached to the bottom. A skateboard rider usually rides the skateboard with one foot on its plywood surface while he propels the skateboard with his other foot. After obtaining speed, he may put both feet on the skateboard as he rides down a roadway.

Skateboard riders perform various stunts with their skateboards. A popular stunt is to grind, or slide, the skateboard on a firm linear object such as a roadside curb, the top of a wall, or a stair railing. Grinding occurs when the skillful skateboard rider causes his skateboard to jump from ground level up and onto the firm linear object and to continue to slide along the surface with only the bottom of the skateboard in contact with the firm linear object.

As this is a stunt for skillful skateboard riders, it takes much practice to master the stunt. Many skateboard riders practice with a skate rail to build up the needed skill. The skate rail consists of a substantial pipe with supports on either end to hold the pipe at a height of a few or several inches off the roadway.

There are currently on the market two main types of skate rails: the "round type" which incorporates a cylindrical cross-sectioned pipe, and the "flat type" which incorporates a square cross-sectioned pipe. Both types have a support at each end to raise the skate rail above the roadway.

Typically the skateboard rider carries or drags the skate rail from the garage to his driveway or to the street where he practices his grinds. He returns the skate rail to the garage when he is done. Some skate rails have the supports permanently mounted to the roadway with screws, glue or some other type fastener. A skate park would have the skate rail permanently mounted.

Accordingly, there is a demand for a dual-function skate rail that incorporates both the round type rail and the flat type rail into one device giving the skateboard enthusiast both popular surfaces for grinding. Such a needed device would take half the storage space in the user's garage. Further, such a device would require the skateboard riders to make only one trip to and from the garage. Still further, the dual-function skate rail may be rotated 180 degrees easily by a ten-year-old child without the use of special tools. A simple locking mechanism is provided to hold the skate rail in position. The present invention accomplishes these objectives.

SUMMARY OF THE INVENTION

The present invention is a dual-function skate rail comprising a single rail with a flat surface on one side and a round surface on the other. The skate rail in held in place by a support on either end which holds the skate rail firmly above the roadway.

An axle is provided on each end of the skate rail. The support on either end of the skate rail provides the mount and bearing surface for the axles. The axles allow the skate rail to be rotated 180 degrees to change from one surface to the other.

A locking mechanism provided in each support is used to hold the skate rail in position with either the flat side or round side on top. The skateboarder must release the locking mechanisms in order to rotate the skate rail 180 degrees. The locking mechanisms are then reapplied to hold the skate rail in the new position.

In accordance with the invention, the dual-function skate rail allows the skateboard rider to choose between a flat surface and a round surface.

DETAILED DESCRIPTION OF THE PREFERRED EMBODIMENT

Figure 1:
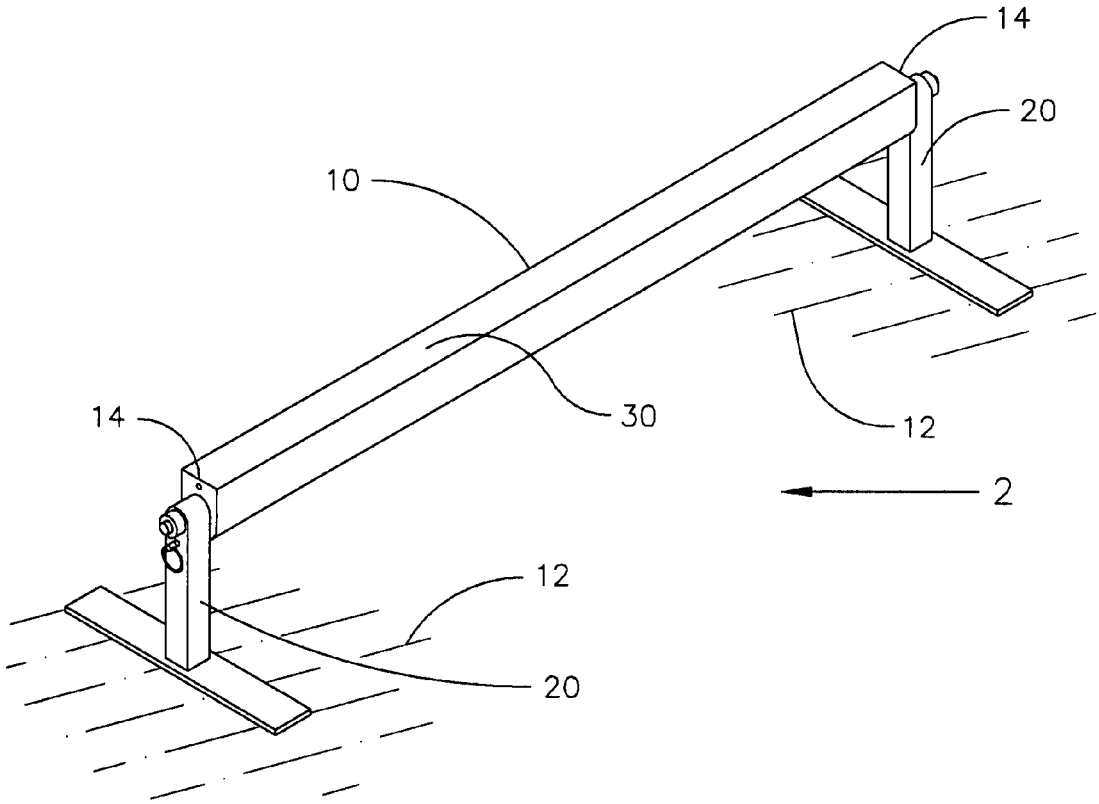
FIG. 1 is a drawing of the invention, illustrating the dual-function skate rail with the flat surface in the up position.
Figure 2:
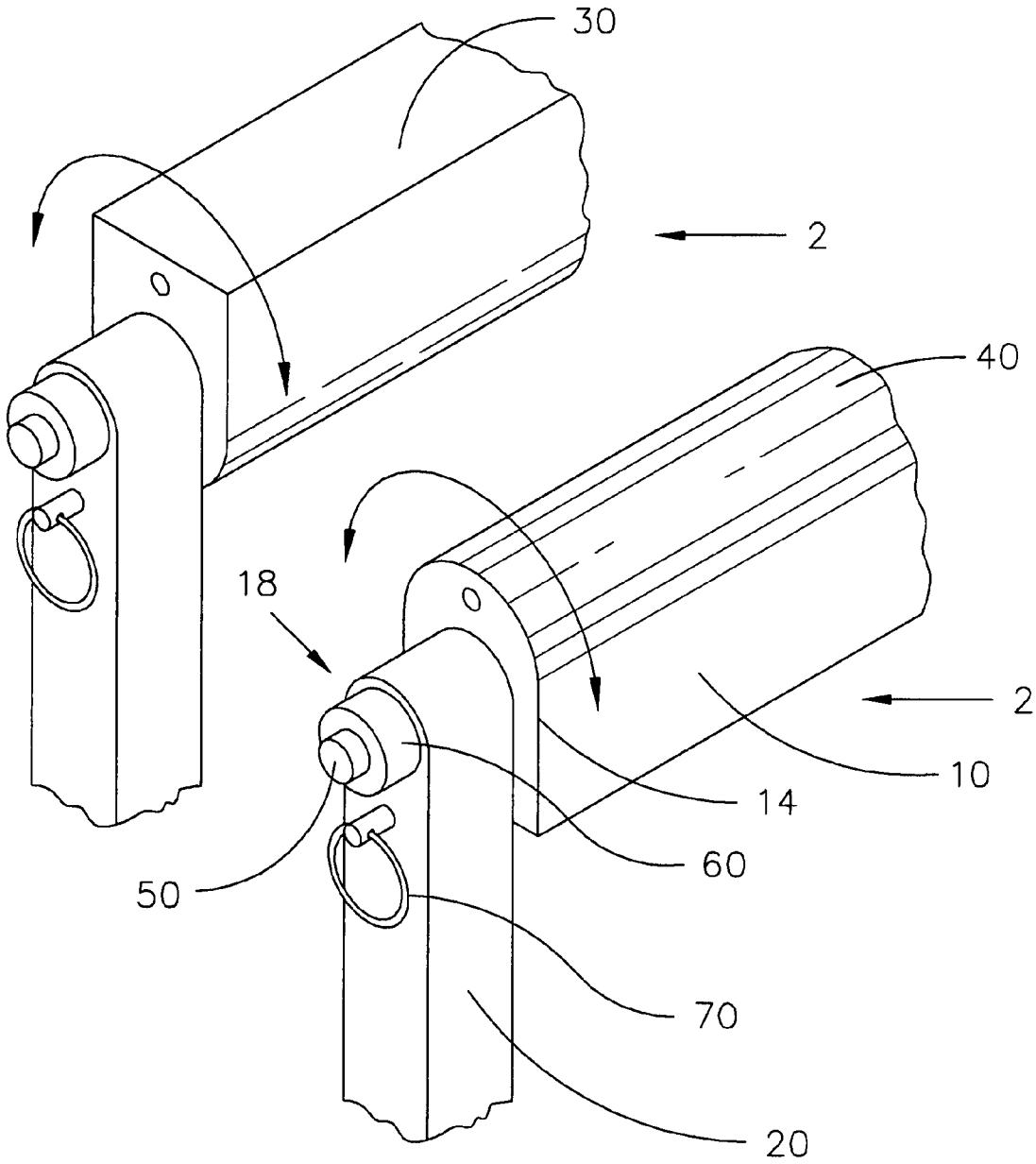
FIG. 2 is a drawing of the invention illustrating the two positions of the dual-function skate rail, with one view of the flat surface up and one view with the round surface up.
Figure 3:
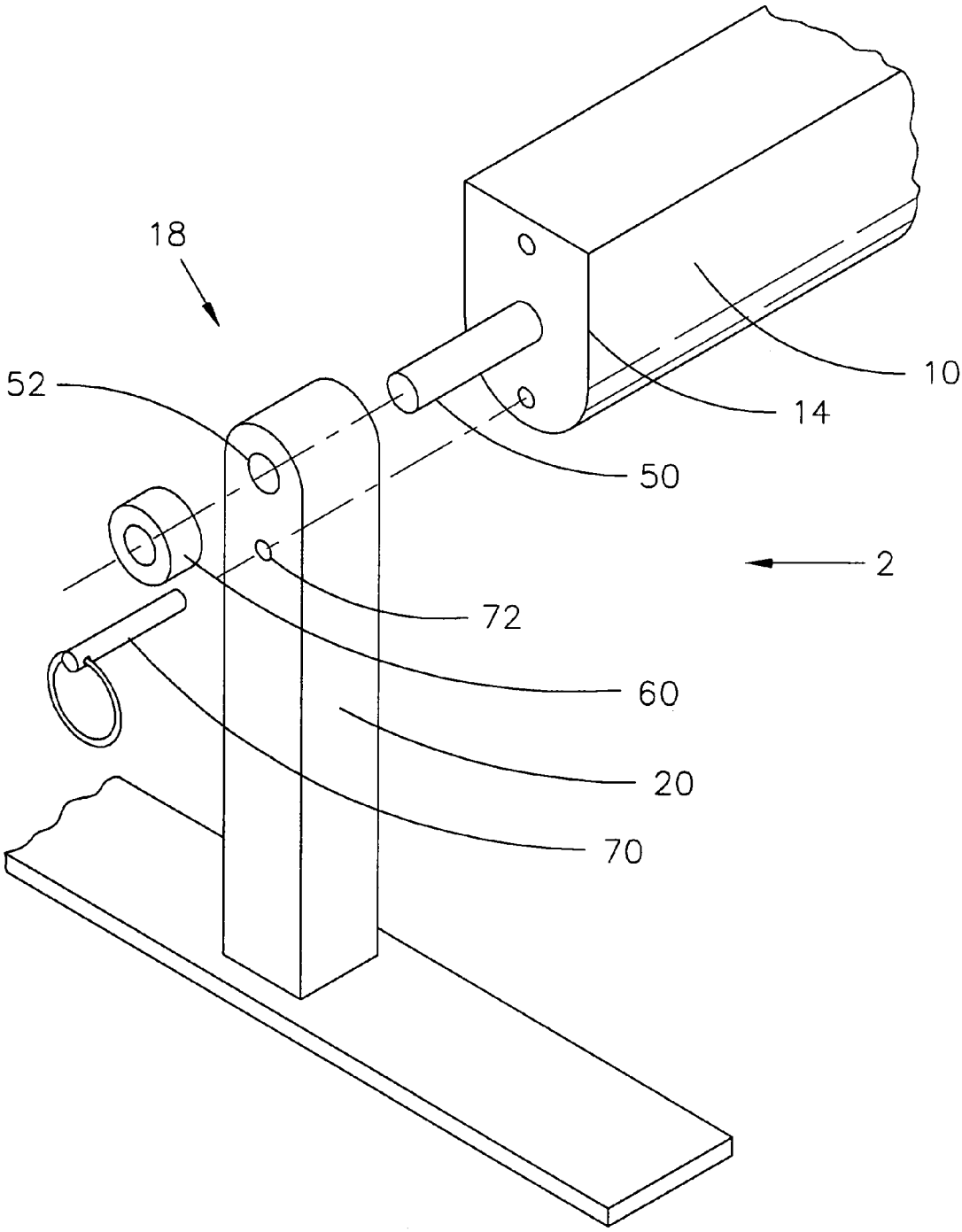
FIG. 3 is an exploded view of the invention showing the individual components on either end of the device: two-sided rail with axle, support, collar, and hitch pin.

The present invention is a dual-function skate rail 2 (FIG. 1), comprising an elongated rail 10 held above a roadway 12 by two supports 20 at either end 14 of the rail 10. FIG. 1 illustrates the skate rail 2 in a position wherein a flat surface 30 of the rail 10 is ready for use by a skateboard rider (not shown), and is in an upward orientation. As shown in FIG. 2, the rail 10 has at least two differently-shaped surfaces 30, 40, such as, a substantially flat surface 30 or a curved surface 40. A rail/support coupling 18 is fixed to each end 14 of the rail 10 and allows the rail 10 to be rotated at least 180 degrees. The rail/support coupling 18 is preferably an axle 50 coaxially aligned with the rail 10 and fixed to each end 14 thereof, as illustrated in FIG. 3, and constrained by a collar 60 fixed to each axle 50. As such, the axle 50 of each end 14 of the rail 10 is inserted through an aperture/bearing surface 52 of each support 20 such that the rail 10 may rotate at least 180 degrees with respect to each support 20.

A locking mechanism 70 locks the rail 10 rotationally with respect to each support 20. The locking mechanism 70 may be a pair of hitch pins used to secure the rail 10 with either the flat surface 30 or the round surface 40 in the upward orientation. As evident in FIGS. 2 and 3, the hitch pins 70 must each be pulled outwardly or removed altogether from an aperture 72 in the rail 10 to allow the rail 10 to be rotated. Preferably, the rail 10 and each supports 20 are made from metal or other substantial material strong enough to carry a skateboard rider's weight and forceful impacts of a skateboard, or the like.

Figure 4:
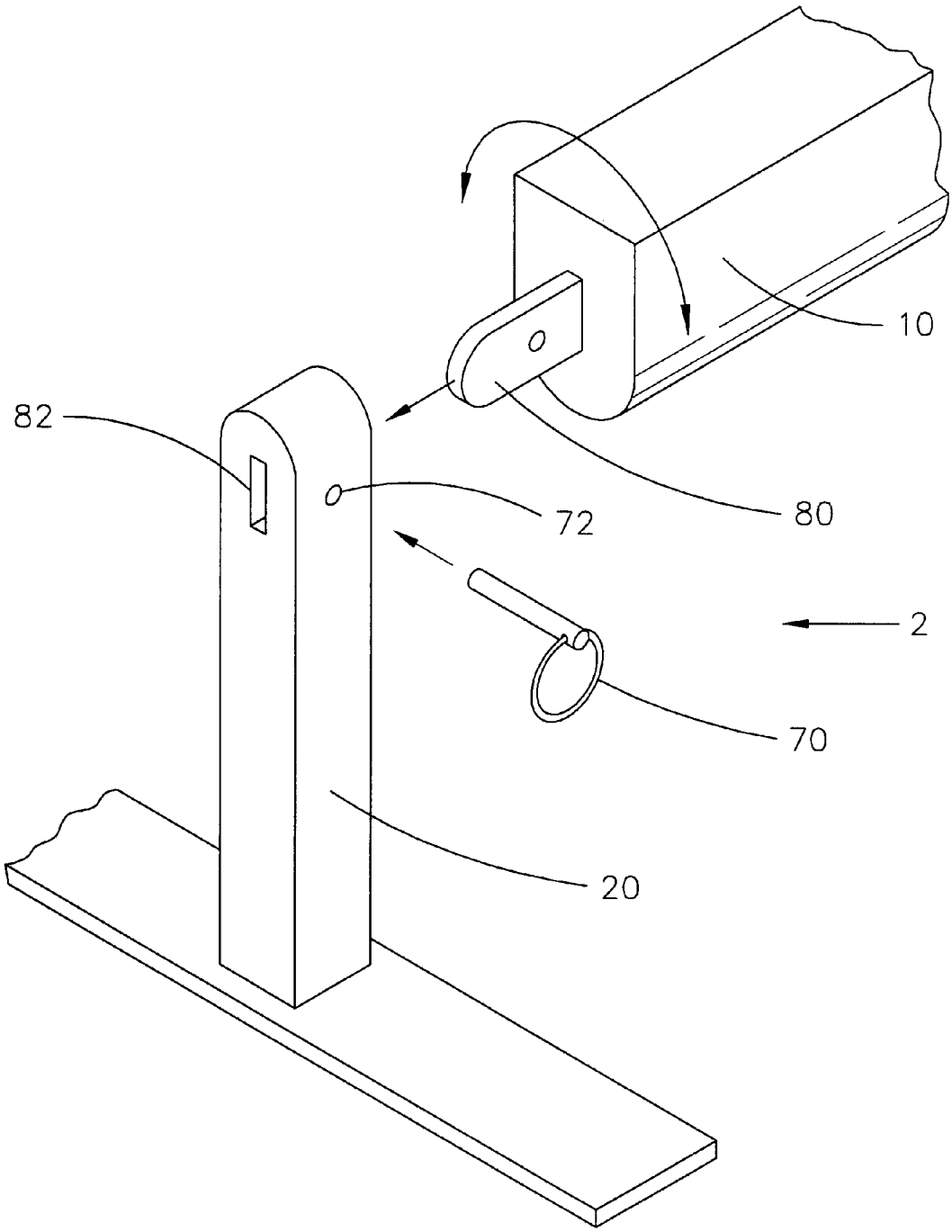
FIG. 4 is an alternate configuration wherein the rail has a flat-shaped tongue on either end which mates with a flat shaped slot in each support and wherein hitch pins are used to lock the supports to the rail.
Figure 5:
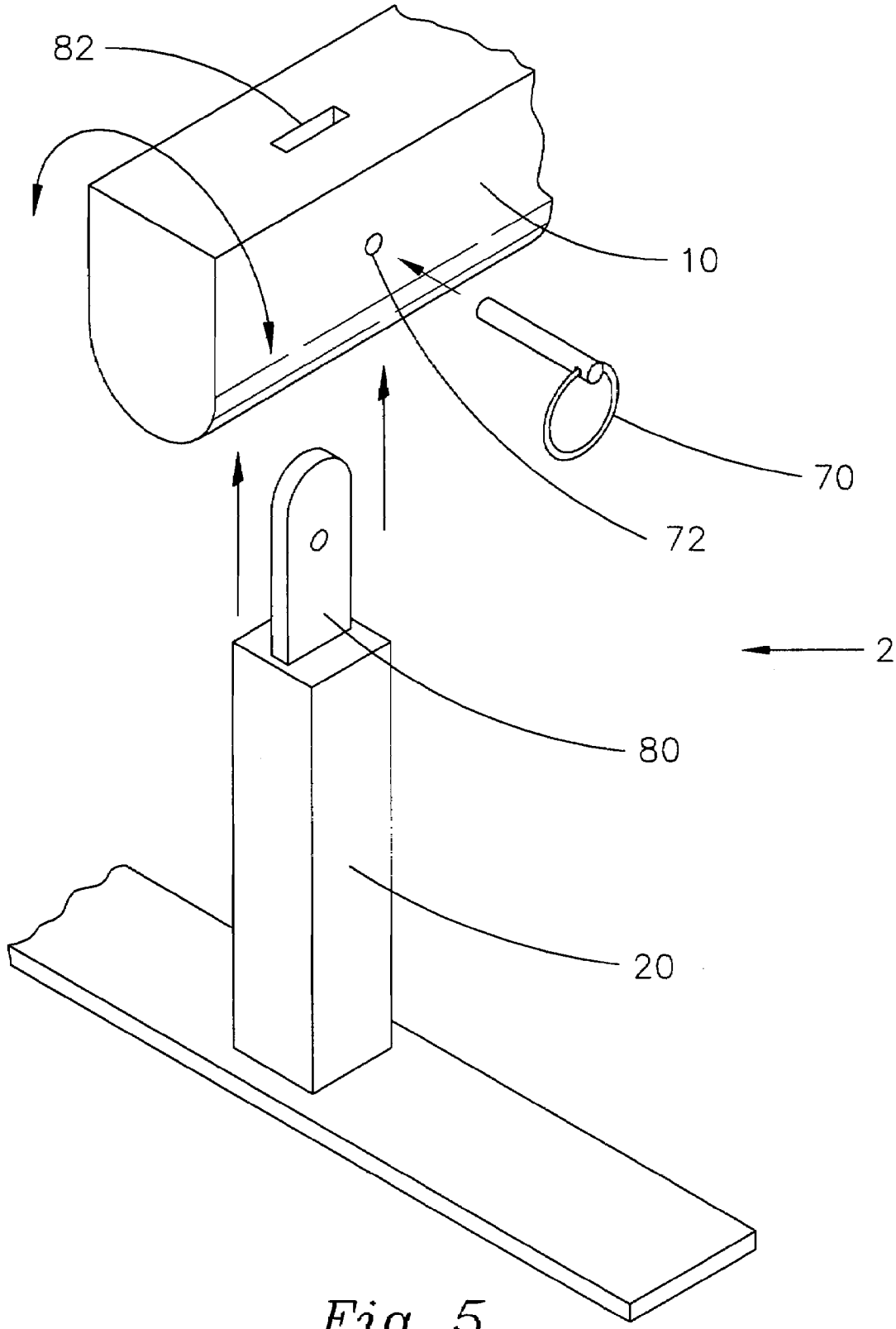
FIG. 5 is a second alternative configuration wherein each support has a flat-shaped tongue which mates with flat shaped slots in the rail and wherein hitch pins are used to lock the supports to the rail.

While a particular form of the invention has been illustrated and described, it will be apparent that various modifications can be made without departing from the spirit and scope of the invention. For example, the exact materials used in the construction of the dual-function skate rail 2 may be modified extensively without changing the nature or scope of the invention. Further, the shape of the supports 20 could be changed without changing function. Further, the means of locking the two-sided rail 10 in position may be modified, and still achieve the objectives of the present invention. Further as illustrated in FIGS. 4 & 5, alternate configurations need not utilize an axle/bearing 50 & 52, but rather a tongue and slot 80 & 82, or similar arrangement, where the rail 10 is completely detached from each support 20, rotated 180 degrees, and reattached in the new position. Accordingly, it is not intended that the invention be limited, except as by the appended claims.

We claim:

1. A skate rail comprising:

a substantial straight rail having at least two differently shaped surfaces;

a rail/support coupling fixed to each end of the rail and allowing the rail to be rotated 180 degrees, each rail/support coupling further including an axle in both ends of the rail for allowing rotational movement of the rail with respect to the supports;

a pair of supports, one support fixed by the rail/support coupling to each end of the rail, for raising the rail above a roadway;

a locking mechanism to lock the rail in place with one of the differently-shaped surfaces facing in an upward orientation.

2. The skate rail of claim 1 wherein one of the differently-shaped surfaces of the rail is a substantially flat surface.

3. The skate rail of claim 2 wherein another of the differently-shaped surfaces of the rail is a curved surface.

4. The skate rail of claim 1 wherein one of the differently-shaped surfaces of the rail is a curved surface.

5. The skate rail of claim 1 wherein each support further includes a bearing surface to mate with the axle for allowing the rail to rotate at least 180 degrees.

* * * * *